US005148149A

United States Patent [19]

Campbell et al.

[11] Patent Number: 5,148,149

[45] Date of Patent: Sep. 15, 1992

[54] DIFFERENTIAL DELAY INTRUSION DETECTION SENSORY SYSTEM

[75] Inventors: David J. Campbell, Baltimore; Kenneth I. DeWitt, Phoenix, both of Md.

[73] Assignee: Allied Security Devices, Inc., Dickerson, Md.

[21] Appl. No.: 648,766

[22] Filed: Jan. 31, 1991

[51] Int. Cl.[5] ..... G08B 13/26

[52] U.S. Cl. ..... 340/562; 324/658; 331/65; 340/539; 340/658

[58] Field of Search ..... 340/562, 567, 658, 572, 340/568, 539, 825.71, 825.7, 825.2, 508, 523, 551-554; 324/658, 681, 683, 326; 331/187, 65; 367/93-94; 342/27-28

[56] References Cited

U.S. PATENT DOCUMENTS

| | | | |
|---|---|---|---|
| 3,516,063 | 6/1970 | Arkin et al. | 340/825.07 |
| 3,683,351 | 8/1972 | Wilcox | 340/568 |
| 3,697,971 | 10/1972 | Domin et al. | 340/562 |
| 3,973,208 | 8/1976 | Diamond | 340/562 X |
| 4,035,798 | 7/1977 | Hackett | 367/94 |
| 4,382,291 | 5/1983 | Nakauchi | 367/93 |
| 4,392,125 | 7/1983 | Iwata | 340/518 |

OTHER PUBLICATIONS

Boylestad et al., "Electronic Devices and Circuit Theory", 3rd ed., 1982, pp. 57-59.

Allied Security Device Inc. Brochure-ASD-100 Security System, copyrighted 1989.

*Primary Examiner*—Jin F. Ng

*Assistant Examiner*—Thomas J. Mullen, Jr.

*Attorney, Agent, or Firm*—Sughrue, Mion, Zinn, Macpeak & Seas

[57] ABSTRACT

An electromagnetic intrusion sensor including a sensing element, a first phase shifter circuit for phase shifting an input or oscillation signal in accordance with a capacitance of the sensing element, a second phase shifter circuit for outputting a reference signal having a fixed delay relative to the input or oscillation signal, a phase detector circuit for providing a detector signal having a duty cycle representing the phase differential between the outputs of the first and second phase shifter circuits, and an oscillator circuit for outputting a signal having a frequency which changes according to the duty cycle of the detector signal.

20 Claims, 5 Drawing Sheets

DIFFERENTIAL DELAY INTRUSION DETECTION SENSORY SYSTEM

FIELD OF THE INVENTION

The present invention relates to electromagnetic intrusion sensors, and specifically, to electromagnetic intrusion sensors which detect the presence of objects by sensing changes in the capacitance of a sensing element.

BACKGROUND OF THE INVENTION

The security of aircrafts and their occupants have become an increasing concern for civil aviation in the past two decades. Specifically, civil aircrafts have become prime targets for terrorists and saboteurs. Further, as a result of the dramatic increase in drug trafficking there have been increased attempts to smuggle illegal drugs and other contraband aboard business aircrafts.

While various electromagnetic intrusion sensor systems have been previously available, such systems have had certain attendant disadvantages. Specifically, the prior systems have been complex in design and costly to produce and install requiring exact calibration and alignment procedures, involving highly trained professionals. As a result, the systems have not been routinely included in corporate aircrafts. Further, false alarms have frequently occurred due to e.g., power fluctuations, environmental changes, or sensor malfunctions. Further, the utilization of multiple sensors in close proximity to each other has been difficult due to mutual interaction of the sensing fields. Finally, the prior systems have required substantial amounts of power in operation, thereby making battery operation difficult.

SUMMARY OF THE INVENTION

Accordingly, it is an object of the present invention to provide an improved intrusion system of the electromagnetic type wherein the foregoing difficulties and disadvantages are substantially eliminated.

It is further an object of the present invention to provide an improved electromagnetic object detection system which is operative over a sensing area of about 24 to 36 inches from the sensing element.

It is still a further object of the present invention to provide an improved intrusion detection system which provides information as to the location of the intruding entity.

It is still a further object of the present invention to provide an improved intrusion detection system which provides a pulsed output signal so that the system can be easily interfaced with digital counting devices.

It is still a further object of the present invention to provide an improved intrusion detection system wherein the state of several sensors may be monitored and compared so as to reduce false alarms caused by conditions affecting a single sensor.

It is still a further object of the present invention to provide an improved intrusion detection system wherein sensors that operate in close proximity to one another employ synchronized sensing fields in order to eliminate interference between adjacent sensors.

It is still a further object of the present invention to provide an improved intrusion detection system which uses an output signal frequency which is unrelated to the frequency of the input signal so as to minimize interference between the two signals.

It is still a further object of the present invention to provide an improved intrusion detection system having sensors which derive their operating power from the conductor that provides the synchronizing signal.

It is still a further object of the present invention to provide an improved intrusion detection system in which semiconductor devices may be employed to minimize power requirements and to make battery operation possible.

It is still a further object of the present invention to provide an improved intrusion detection system having a relatively simple sensor circuit design. thereby allowing for a low production cost.

It is still a further object of the present invention to provide an improved intrusion detection system which provides a self correction function, to compensate for variations in installation, changes in environment, and aging of components The present invention accomplishes these and other objects by providing an electromagnetic intrusion sensor for sensing the presence of an object in accordance with a frequency of a sensor output signal. The sensor includes a sensing element; a first phase shifter circuit for phase shifting an input signal in accordance with a capacitance of the sensing element so as to output a sense signal; a second phase shifter circuit for outputting a reference signal having a fixed delay relative to said input signal; a phase detector circuit, coupled to receive the sense and reference signals, for providing a detector output signal having a duty cycle representing the phase differential between the sense and reference signals; and an oscillator circuit, coupled to receive the detector output signal, for providing the sensor output signal having a frequency which changes in accordance with the duty cycle of the detector output signal so that when the object is disposed within a predetermined range of the sensing element the capacitance thereof changes causing the duty cycle of the detector output signal to change, thereby changing the frequency of the sensor output signal.

Further objects and advantages of the present invention will become apparent from a consideration of the drawings and the following description.

BRIEF DESCRIPTION OF THE DRAWINGS

In the drawings, closely related elements have identical numbers but different letter suffixes.

DESCRIPTION OF THE PREFERRED EMBODIMENTS

Figure 1:
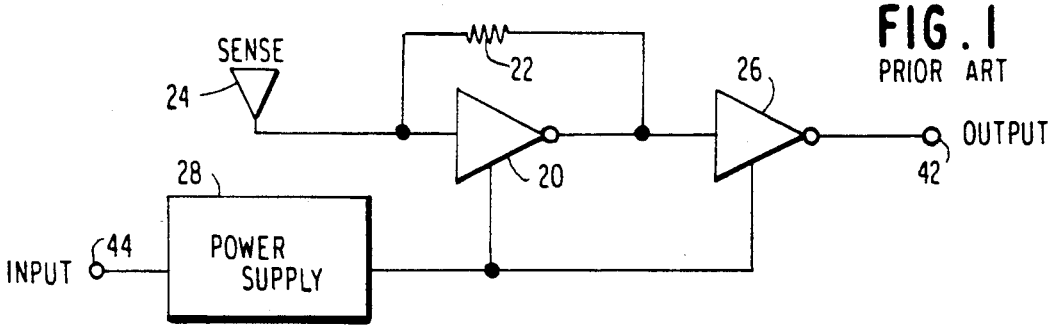
FIG. 1 PRIOR ART
FIG. 1 is a block diagram of a conventional intrusion sensor.

Referring to FIG. 1, the prior art sensor shown therein includes an inverting amplifier 20 which is similar to the TL062 dual op amp manufactured by Texas Instruments. A resistor 22 and a sensing element 24 constitute an oscillatory circuit for a free running multivibrator. The frequency of oscillation is determined by the resistor 22 and the capacitive characteristic of the sensing element 24. This oscillation circuit is coupled to the output 42 through a second inverting amplifier 26 acting as a buffer, so that loading on the output line does not affect the frequency of operation. Power for the sensor is derived from a DC input line by a power supply circuit 28. filtered and decoupled so as to have minimal effect on frequency.

The presentation of an object in close proximity to the sensing element 24 causes an increase in the capacitance thereof and a subsequent downward shift in the output frequency. This change in frequency signals a central processor that an intrusion is in progress.

Figure 2:
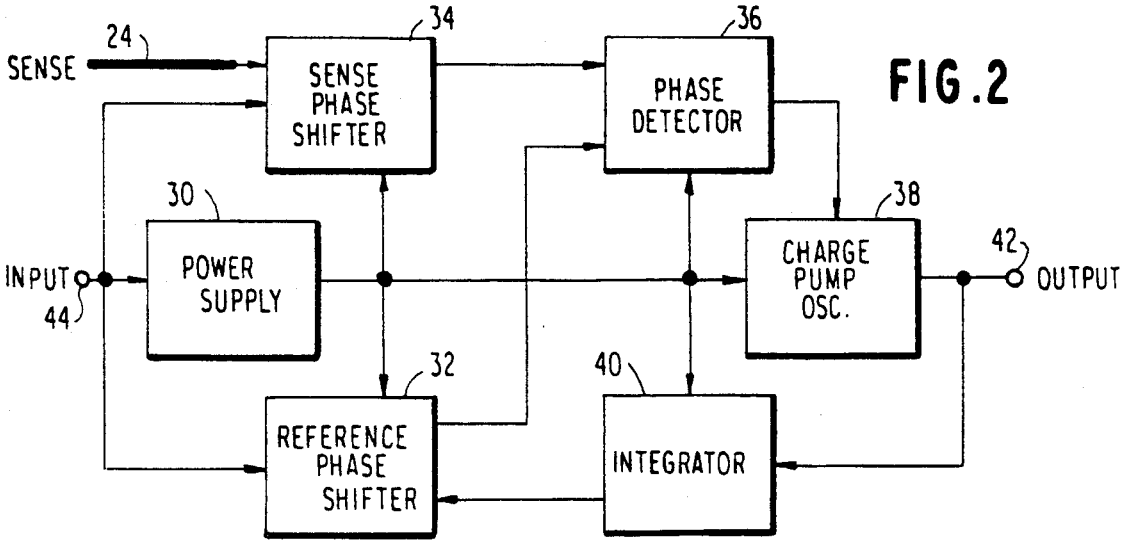
FIG. 2 is a block diagram of the intrusion sensor according to an embodiment of the invention.

An intrusion sensor in accordance with the present invention is shown in FIG. 2. Power is derived by the power supply circuit 30 from the sensor input signal which is a pulsed DC waveform operating at 455 KHz. This input signal is also fed to two phase shift circuits 32 and 34. The first phase shift circuit 34 provides a phase shift of the input signal in accordance with changes in the capacitive loading on the sensing element 24. The second circuit 32 provides a reference signal having a fixed delay with respect to the input signal 44 such that the reference signal lags behind the sense output signal from circuit 34 by about 45 degrees. Both the sense and reference signals are fed to a phase detector 36 which outputs a high going pulse during any period when the two signals are out of phase with each other. Thus any changes in the phase of the sense signal will cause a change in the duty cycle of the detector output signal from phase detector 36. This phase difference signal is applied to a charge pump oscillator 38, which is a free running low frequency oscillator whose frequency changes in response to the duty cycle of the phase detector output signal. The frequency change of this sensor output signal 42 is accomplished by changing the pulse width of the low going portion of the output waveform, thus changing the duty cycle. This sensor output signal 42 is then applied to a long time integrator 40 which converts signal 42 into an error signal that is fed back to the phase shifter circuit 32 to compensate for long term changes in the sensor's operating environment. The sensor output signal is stripped of residual high frequencies and returned on the sensor output lead to a local processor.

Figures 5, 6, 7:
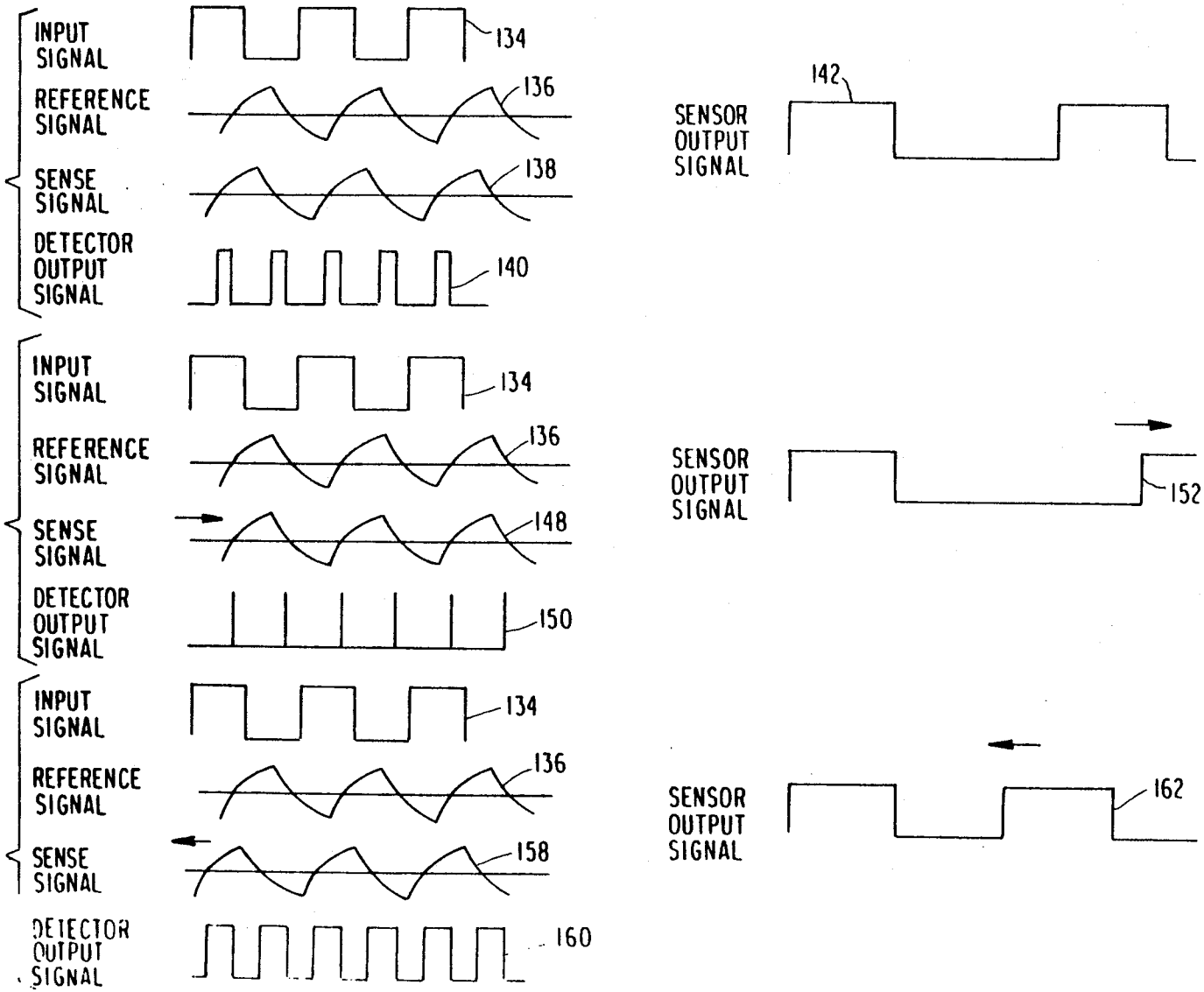
FIG. 5 is a waveform diagram showing waveforms at various points in the intrusion sensor circuit during normal or non-intruded operation.
FIG. 6 is a waveform diagram showing waveforms at various points in the intrusion sensor circuit immediately following an intrusion.
FIG. 7 is a waveform diagram showing waveforms at various points in the intrusion circuit immediately following removal of an intrusion.

FIGS. 5, 6 and 7 show waveforms present within the sensor system at various stages of operation. FIG. 5 shows the waveforms for a sensor during a normal or non-intruded condition. The reference signal 136 lags the input signal 134 by about 500 nanoseconds, while the sense signal 138 lags the input signal 134 by about 125 nanoseconds. This phase difference results in a detector output signal 140 having pulses each with a duration of 125 nanoseconds. These pulses are applied to charge pump oscillator 38 which outputs a sensor output signal 152 having a frequency of about 9 KHz.

FIG. 6 shows the waveforms for a sensor subsequent to the onset of a fully intruded condition. The input signal 134 and the reference signal 136 remain unchanged during this condition, but the sense signal 158 shifts in phase until it lags the input signal by about 250 nanoseconds. This places the sense signal 158 almost in phase with the reference signal 136 and therefore the detector output signal 150 almost disappears. This causes the sensor output signal 152 to shift downward in frequency to a value below 5 KHz.

FIG. 7 shows the waveforms for a sensor just following the removal of the intruding object. Again the input signal 134 and the reference signal remain the same, but the sense signal 158 shifts in phase until it lags the input signal 134 by less than 50 nanoseconds. This phase difference causes the detector output signal 160 to contain pulses each having a duration of 750 nanoseconds. This causes the sensor output signal 162 to shift upward in frequency to a value above 12 KHz.

Thus, according to the sensor of the invention, when an instrusion is introduced, the sensor output frequency will shift downwards. This frequency will then slowly return to its original or normal frequency. When the intruding entity is removed, the frequency of the sensor output will shift upwards, and then slowly return to the normal frequency.

Figure 3:
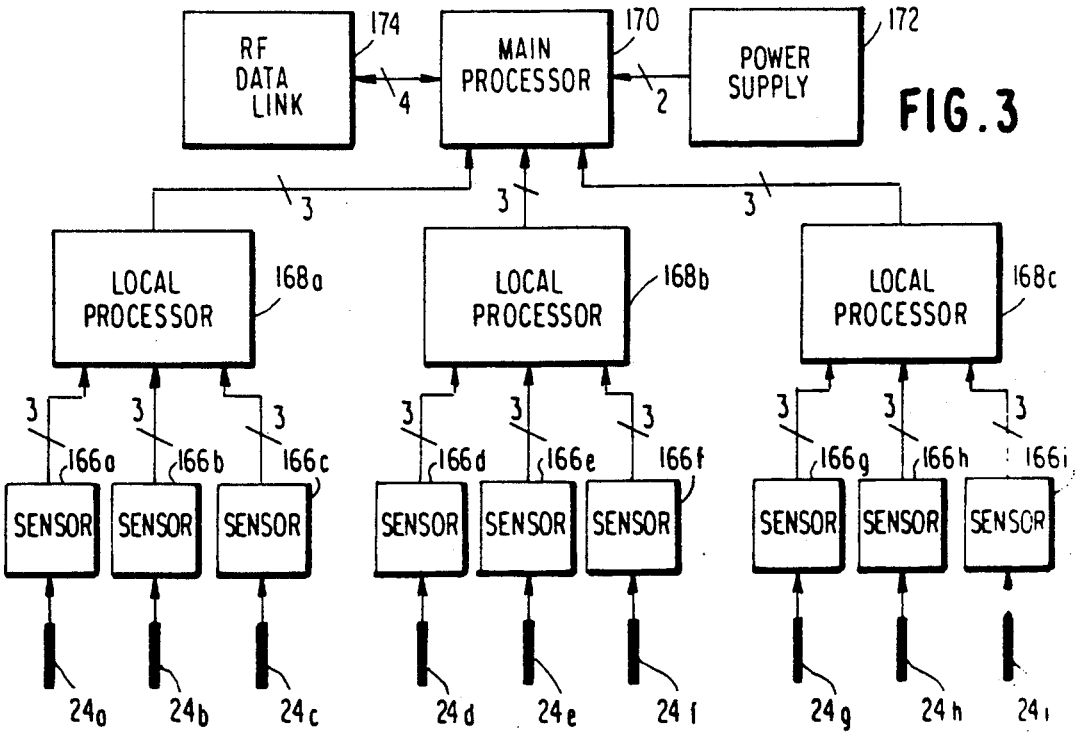
FIG. 3 is a block diagram of the intrusion sensor system in accordance with the invention.

FIG. 3 shows an embodiment of an intrusion detection system employing the sensor configuration of FIG. 2. Several sensors 166A, 166B and 166C are installed in such a manner that their respective sensing elements 24A, 24B and 24C are in close proximity to each other. All sensors are connected to a local processor 168A such that their grounds and their inputs are common. The output of each sensor 166A–166C is connected to a separate input of the local processor 168A. Since the inputs are common, the sensing fields of all the senors can be synchronized so as to not interfere with each other. This configuration is repeated at other locations for local processors 168B and 168C and sensors 166D–166I. The local processors 168A–168C monitor the respective sensors to detect true intrusions while rejecting false conditions. This is accomplished by comparing, for example, the three outputs of the sensors 166A–166C (three inputs to Local Processor 168A). Since the sensor elements 24A–24C are in close proximity to each other, the output of each of the sensors 166A–166C should be the same. Thus, if one sensor outputs a signal indicating an intrusion, but the other two sensor output signals indicate no intrusion, the local processor 168A determines that a false alarm has occurred. Local processors 168B–C and sensors 166D–I operate in a like manner. The outputs of the local processors 168A–166C are fed to the input of a central or main processor 170 which controls data communications and system status. The main processor 170 stores data representing the outputs of the local processors 168A–168C at respective address locations. By interrogating the main processor 170, the status of each local processor and thus each group of sensors 166A–166C, 166D–166F and 166G–166I can be obtained. The status of the main processor 170 can be obtained remotely via the RF data link 174 as is well known in the art. The sensors 166A–166I. the local processors 168A–168C and the main processor 170 can be implemented with semiconductor devices. This allows for the entire intrusion detection system to be powered from a rechargeable battery power supply 172.

Figure 4:
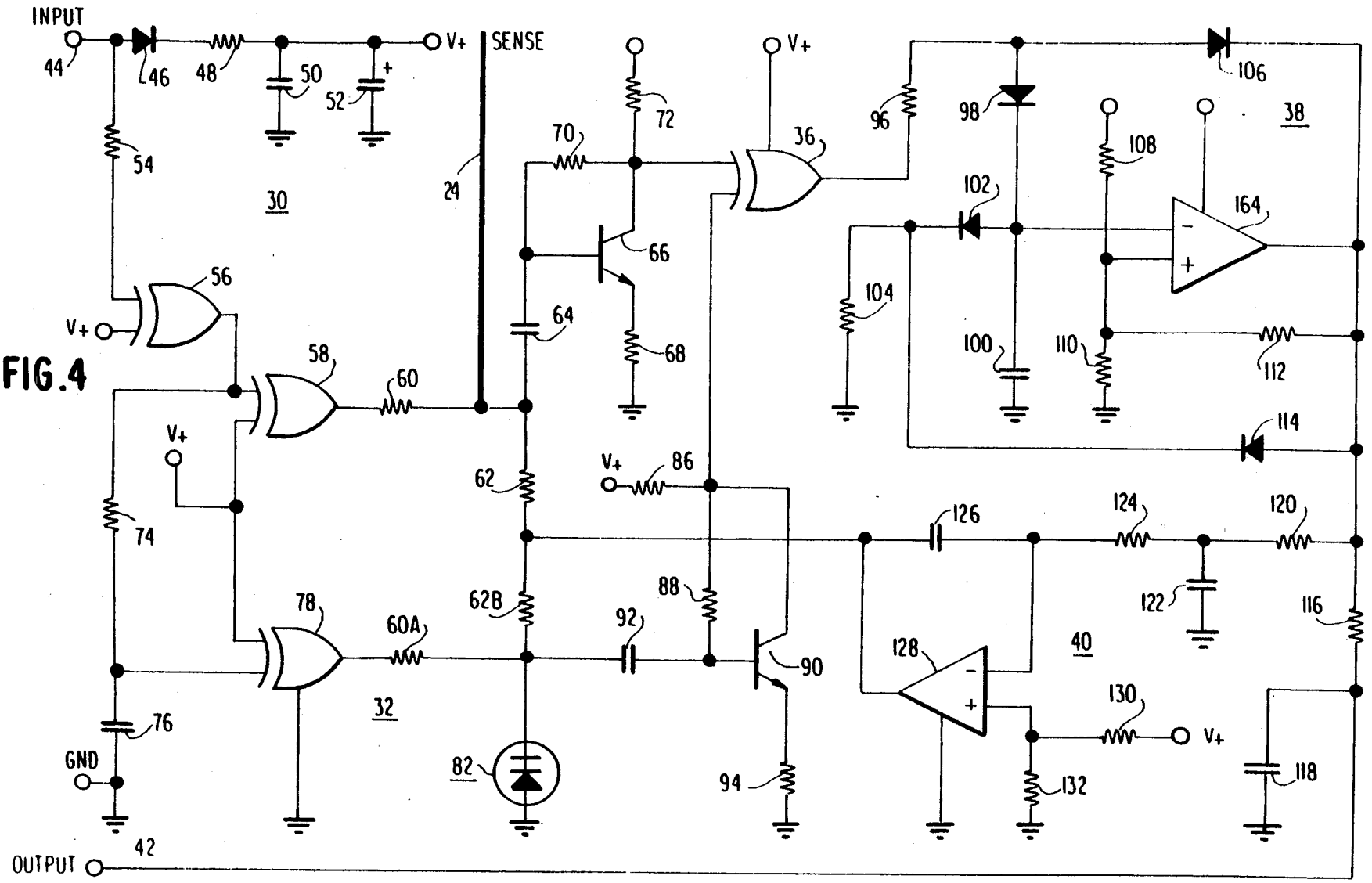
FIG. 4 is a circuit diagram of the intrusion sensor of FIG. 2.

The intrusion sensor of FIG. 2 is shown in greater detail in the circuit diagram of FIG. 4.

The sensor input 44 is a pulsed DC waveform having a 50% duty cycle square wave with a frequency of about 455 KHz. The power of the sensor circuitry is obtained from the sensor input 44 by the power supply circuit 30. The 455 KHz pulsed DC waveform 44 is rectified by diode 46 and filtered by resistor 48 and capacitor 52. Capacitor 50 is included for RF decoupling. The 455 KHz signal is applied as one input of a quad exclusive OR gate 56 similar to an MC144080BE manufactured by Motorola Inc.. through a resistor 54. The other input of exclusive OR gate 56 is coupled to a voltage supply V+. so that exclusive OR gate 56 serves to invert and condition the input signal 44 and provide isolation for the rest of the circuitry.

The output of exclusive OR gate 56 is connected to one input of another exclusive OR gate 58 whose other input is also coupled to voltage supply V+. The output of gate 58 is connected through a divider network, consisting of resistors 60 and 62, which provides a 455 KHz waveform with an amplitude of about one tenth V+ to the sensing element 24. Resistor 62 also provides a DC level that is consistent with that found in the reference signal circuit 32 so that similarity between the waveforms is maintained. The sensing element 24 is typically implemented as a twelve to twenty-four inch length of insulated wire mounted one inch away from any adjacent surface and connected to a twelve inch length of shielded cable that leads into the sensor enclosure. The capacitance of the sensing element typically varies between fifty and two hundred picofarads, depending upon the environment surrounding element 24. The phase of the 455 KHz waveform at the junction of resistors 60 and 62 is defined by the relation between the parallel resistance of 60 and 62, and the capacitance of the sensing element. Any change of the capacitance of this element 24 will result in a shift in the phase of the waveform. Thus, an object approaching within eighteen to twenty-four inches from the sensing element 24 will cause a shift in the phase of the sensing waveform. This waveform is AC coupled to the base of transistor 66 by capacitor 64. The gain of the transistor amplifier is set by the relation of collector resistor 72 and emitter resistor 68. Base bias current is provided by resistor 70 which feeds back current from the collector of the transistor 66.

The output of exclusive OR gate 56 is connected to one input of another exclusive OR gate 78 through a delay network composed of resistor 74 and capacitor 76. The function of this delay network is to insure that the phase of the reference signal will lag that of the sense signal under all conditions. The other input of gate 78 is tied to +V giving the gate an inverting characteristic. The output of gate 78 is connected through a divider network of resistors 60A and 62B, which provides a 455 KHz waveform with an amplitude of about one tenth V+ to varicap 82. The phase of the 455 KHz waveform across the varicap 82 is set by the parallel resistance formed by resistors 60A and 62B, and the capacitance of the varicap 82. Resistor 62B also provides an error signal from the integrator 40 op amp 128 that adjusts the capacitance of the varicap 82 to match long term changes in the average capacitance of the sensing element 24. Thus the waveform across the varicap 82 acts as a phase reference against which the sense signal will be compared. The waveform across the varicap 82 is AC coupled to the base of transistor 90 by capacitor 92. The gain of the transistor amplifier is set by the relation of collector resistor 86 and emitter resistor 94. Base bias current is provided by resistor 88 which feeds back current from the collector of transistor 90.

The sense signal from the collector of transistor 66 is connected to one input of another exclusive OR gate 36, whose other input is connected to the collector of transistor 90 on which is found the reference signal. The function of gate 36 is to provide a high going pulse during any period in which the phase of the input signals (i.e., sense and reference signals) does not match. Thus the detector output signal is a pulse width modulated waveform that has a frequency twice that of the input signal and a pulse width proportional to the difference in capacitance between the varicap 82 and the sensing element 24.

The detector output signal is connected to a low frequency charge pump oscillator 38 through resistor 96 and diode 98. The inverting input of amplifier 164 is connected to capacitor 100. The period during which the output of amplifier 164 is low is a constant, controlled by the discharge of capacitor 100 across resistor 104 through diode 102. During this same period the input from resistor 96 is disabled, held low by diode 106. This period ends when the voltage across capacitor 100 equals that set by the divider network composed of resistor 108 in series with the parallel combination of resistors 110 and 112 connected to the non-inverting input of amplifier 164. After this period, the output of amplifier 164 goes high releasing the diode 106 clamp rom resistor 96, and preventing further discharge through resistor 104 by clamping it high through diode 114. The capacitor 100 is isolated from this clamping by blocking from diode 102. The period during which the output of the amplifier 164 is high is controlled by the charging of capacitor 100 from the phase detector output through resistor 96 and diode 98. This period ends when the voltage across capacitor 100 equals to that set by the divider network composed of the parallel combination of resistors 109 and 112 in series with resistor 110, and is inversely proportional to the pulse width of the phase detector output. Therefore the frequency of the sensor output signal will be proportional to the difference in capacitance between the varicap 82 and the sensing element 24 seeking a lower value when the presence of an intruding object causes an increase in the capacitance of the sensing element 24.

The output from op amp 164 is connected to a filter network composed of resistor 116 and capacitor 118, for the purpose of removing residual of the 455 KHz signal. The sensor output line is connected across capacitor 118.

The output of amplifier 164 is also connected to a long time integrator 40 whose purpose is to derive an averaged DC error signal based on the duty cycle of the sensor output signal. The output of amplifier 164 is connected to resistor 120 which acts with capacitor 122 as a low pass filter. This filter is connected to resistor 124 which acts with capacitor 126 and amplifier 128 as a miller ramp generator with a several second time constant. Resistors 130 and 132 act to set the voltage assumed directly after voltage is first applied to the circuit. Since the frequency of the sensor output signal is proportional to the capacitive difference between the varicap 82 and the sensing element 24 and since the capacitance of the former must always exceed the latter, the error signal will change proportionally to the capacitance in the sensing element 24. This error signal is fed back through resistor 62B to the varicap 82 acting to adjust it's capacitance. The capacitance of the varicap 82 is inversely proportional to the reverse voltage across it, so the error signal serves as a negative feedback element tending to preserve the steady state phase relation between the sense signal and the reference signal.

Figure 8:
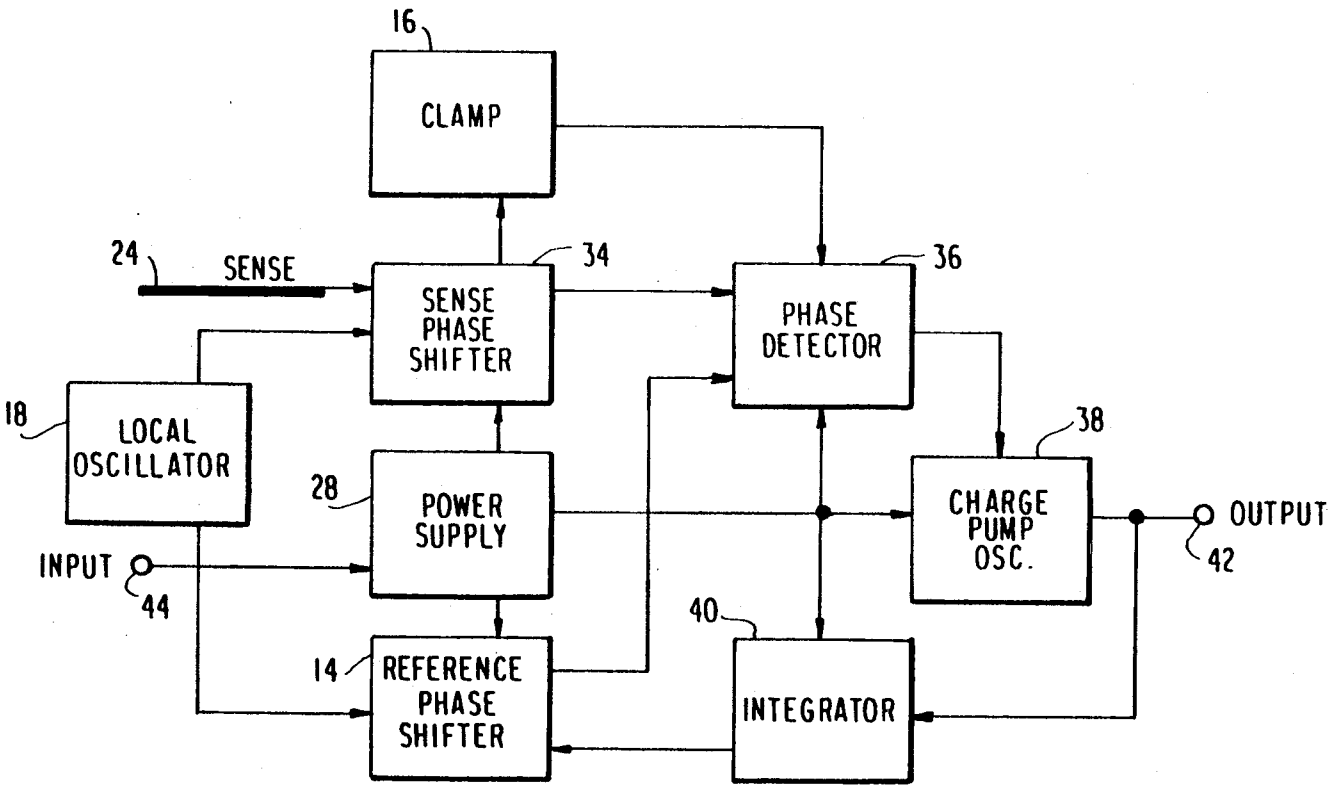
FIG. 8 is a block diagram of the intrusion sensor according to another embodiment of the invention.

Another embodiment of the intrusion sensor according to the invention is shown in FIG. 8. This embodiment is similar to the embodiment of FIG. 2. However, in this embodiment, the signal input 44 is used only for the DC power supply: input 44 is not supplied to the sense and phase shifters. Rather, the output of a local oscillator 18 is supplied to the sense phase shifter 34 and the reference phase shifter 14. Further, this embodiment includes a clamper circuit 16 for clamping the output of the phase detector 36, as will be discussed in more detail.

Figure 9:
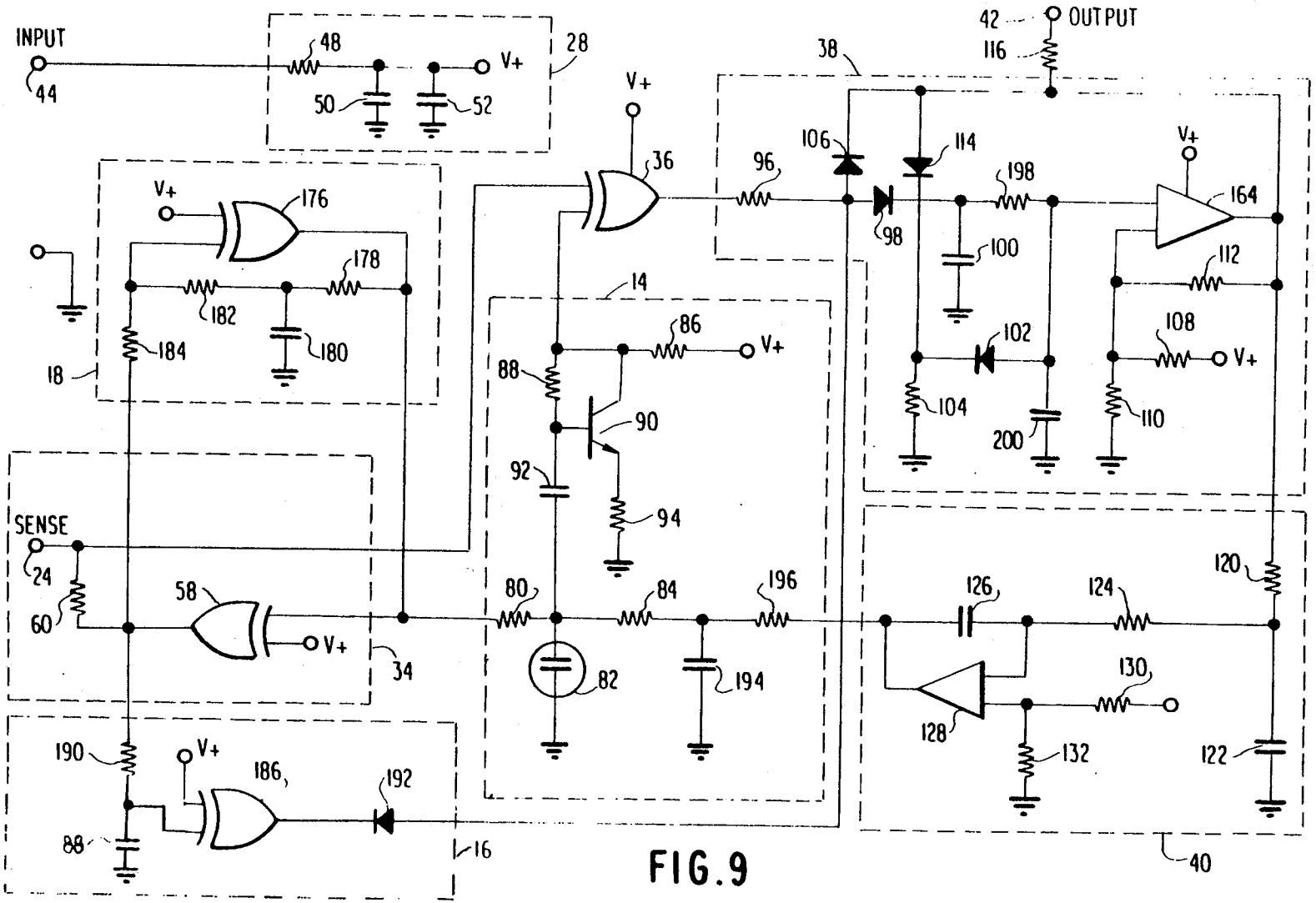
FIG. 9 is a circuit diagram of the intrusion sensor of FIG. 8.

FIG. 9, which is a circuit diagram of the sensor element shown in FIG. 8, will now be described.

The sensor input 44 requires a regulated DC supply voltage. The power for the sensor circuitry is obtained from the sensor input 44 by the power supply circuit 30. This DC voltage is filtered by resistor 48 and capacitor 52. A capacitor 50 is included for RF decoupling. A 455 KHz signal is generated by quad exclusive OR gate 176 which may be similar to an MC144070BE manufactured by Motorola Inc. One input of gate 176 is tied to V+, so that gate 176 acts as an inverter type oscillator circuit whose frequency of operation is determined by resistor 178 and capacitor 180. Resistors 182 and 184 provide positive feedback, both for hysteresis and to assure that the input of gate 176 does not remain in it's region of linear operation. The output of exclusive OR gate 176 is connected to one input of exclusive OR gate 58 whose other input is tied to V+. The output of gate 58 is connected through resistor 60 which provides a 455 KHz waveform to the sensing element 24.

The sensing element 24 may be implemented as a twelve to twenty-four inch length of insulated wire mounted one inch away from any adjacent surface and connected to a twelve inch length of shielded cable that leads into the sensor enclosure. The capacitance of the sensing element typically varies between 50 and 200 picofarads, depending upon the environment surrounding the sensing element 24. The phase of the 455 KHz waveform at the junction of resistors 60 and the sensing element 24 is defined by the relation between the resistance of resistor 60, and the capacitance of the sensing element 24. Any change of the capacitance of sensing element 24 will result in a shift in the phase of this "sensing waveform". An object approaching within approximately 18 to 24 inches from the sensing element 24 will cause a shift in the phase of the sensing waveform.

The output of exclusive OR gate 58 is connected to one input of exclusive OR gate 186 through a delay network composed of resistor 190 and capacitor 188. The the delay network together with gate 186 and diode 192 form a clamp circuit 16. The function of the delay network is to insure that sufficient delay is provided before activation of the clamp circuit so that only the detector output pulse generated by the falling edge of the sense waveform is clamped. The other input of gate 186 is tied to V+ giving the gate an inverting characteristic.

The output of exclusive OR gate 176 is also connected through a resistor divider circuit comprised of resistors 80 and 84 which provides a 455 KHz waveform with one tenth the amplitude to varicap 82. The phase of the 455 KHz waveform across the varicap 82 is set by the parallel resistance formed by resistors 80 and 84, and the capacitance of the varicap 82. Resistor 84 also provides an error signal from the op amp 128 of integrator 40 which adjusts the capacitance of the varicap 82 to match long term changes in the average capacitance of the sensing element 24. Thus the waveform across the varicap 82 acts as a phase reference against which the sense signal will be compared.

The waveform across the varicap 82 is AC coupled to the base of transistor 90 by capacitor 92. The gain of this transistor amplifier is set by the relation of collector resistor 86 and emitter resistor 94. The base bias current is provided by resistor 88 which feeds back from the collector of the transistor 90. The sense signal is connected to one input of an exclusive OR gate 36 and the other input of gate 36 is connected to the collector of transistor 90 on which is found the reference signal. The exclusive OR gate 36 serves as a phase comparator. Specifically, the function of gate 36 is to provide a high going pulse during any period in which the phase of the input signals does not match. Thus the detector output signal is a pulse width modulated waveform that has a frequency twice that of the input signal and a pulse width proportional to the difference in capacitance between the varicap 82 and the sensing element 24.

The detector output signal is connected to a low frequency charge pump oscillator 38 through resistor 96 and diode 98. The inverting input of amplifier 164 is connected to capacitor 200. The period during which the output of amplifier 164 is low is constant, controlled by the discharge of capacitors 100 and 200 across resistors 198 and 104 through diode 102. The resistor 198 and capacitor 200 provide a filtering effect to reduce the stepping effect during charging pulses from the detector 36. During this same period the input from resistor 96 is disabled, held low by diode 106. This period ends when the voltage across capacitor 200 equals that set by the divider network composed of resistor 108 in series with the parallel combination of resistors 110 and 112 connected to the non-inverting input of amplifier 164. After this period, the output of amplifier 164 goes high releasing the diode 106 clamp from resistor 96, and preventing further discharge through resistor 104 by clamping it high through diode 114.

The capacitor 200 is isolated from this clamping by blocking diode 102. The period during which the output of the amplifier 164 is high is controlled by the charging of capacitors 100 and 200 from the phase detector output through resistors 96 and 198 and diode 98. This period ends when the voltage across capacitor 200 equals to that set by the divider network composed of the parallel combination of resistors 108 and 112 in series with resistor 110, and is inversely proportional to the pulse width of the phase detector output. Therefore the frequency of the sensor output signal will be proportional to the difference in capacitance between the varicap 82 and the sensing element 24 seeking a lower value when the presence of an intruding object causes an increase in capacitance of the sensing element 24.

The output form op amp 164 is connected to the sensor output 42 through resistor 116. The output of amplifier 164 is also connected to a long time integrator 40 which derives an averaged DC error signal based on the duty cycle of the sensor output signal. The output of amplifier is also connected to resistor 120 which acts with capacitor 122 as a low pass filter. This filter is connected to resistor 124 which acts with capacitor 126 and amplifier 128 as a miller amp generator with a several second time constant. Resistors 130 and 132 act to set the voltage assumed directly after a voltage is first applied to the circuit. Since the frequency of the sensor output signal is proportional to the capacitive difference between the varicap 82 and the sensing element 24 and since the capacitance of the former must always exceed the latter, the error signal will change proportionally to the capacitance of the sensing element 24. This error signal is fed back through resistors 84 and 196 to the varicap 82 acting to adjust it's capacitance. Resistor 196 acts with capacitor 194 to decouple the presence of 455 KHz noise which may be present on the DC error signal. The capacitance of the varicap 82 is inversely proportional to the reverse voltage across it so the error signal serves as a negative feedback signal which serves to preserve the steady state phase relation between the sense signal and the reference signal.

What is claimed is:

1. An electromagnetic intrusion sensor for sensing the presence of an object in accordance with a frequency of a sensor output signal, said sensor comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (36), coupled to receive said sense and reference signals, for providing a detector output signal having a duty cycle representing the phase differential between said sense and reference signals; and oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal.

2. The sensor as defined in claim 1, further comprising processing means for monitoring the frequency of the sensor output signal.

3. The sensor as defined in claim 1, further comprising a power supply circuit (30), connected to receive the input signal, for supplying power to said first and second shifter circuits, said phase detector circuit and said oscillatory means.

4. The sensor as defined in claim 1, wherein the predetermined range is between 18 and 24 inches.

5. An electromagnetic intrusion sensor for sensing the presence of an object in accordance with a frequency of a sensor output signal, said sensor comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (35), coupled to receive said sense and reference signals, for providing a detector output signal having a duty cycle representing the phase differential between said sense and reference signals;

oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal; and an integrator (40), connected to receive the sensor output signal, for converting the sensor output signal to an error signal, said second phase shifter circuit being responsive to the error signal for changing an amount of delay of the reference signal relative to the input signal.

6. The sensor as defined in claim 5, wherein the error signal is a voltage signal, and wherein said second phase shifter circuit changes the amount of delay of the reference signal in accordance with a magnitude of the voltage error signal.

7. An electromagnetic intrusion sensor for sensing the presence of an object in accordance with a frequency of a sensor output signal, said sensor comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (36), coupled to receive said sense and reference signals, for providing a detector output signal having a duty cycle representing the phase differential between said sense and reference signals;

oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal; and a power supply circuit (30), connected to receive the input signal, for supplying power to said first and second shifter circuits, said phase detector circuit and said oscillatory means, wherein the input signal is a 455 KHz squared wave, and wherein said power supply circuit is connected to receive the input signal.

8. An electromagnetic intrusion sensor for sensing the presence of an object in accordance with a frequency of a sensor output signal, said sensor comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (36), coupled to receive said sense and reference signals, for providing a detector output signal having a duty cycle representing the phase differential between said sense and reference signals;

oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal, wherein the sensor output signal is a pulse signal having a frequency not more than 5 KHz when the object is within the predetermined range of said sensing element.

9. An electromagnetic intrusion sensor system for sensing the presence of an object in accordance with a frequency of a sensor output signal, said system comprising:

a plurality of sensor means each comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (36), coupled to receive said sense and reference signals, for providing a detector output signal having a duty cycle representing the phase differential between said sense and reference signals; and oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal.

10. The system as defined in claim 9, further comprising a plurality of local processing means each operable for monitoring the frequency of at least one sensor output signal of the plurality of sensor means, and for outputting a status signal in accordance with the monitored at least one sensor output signal, the status signal representing whether an object is present.

11. The system as defined in claim 10, further comprising a main processor for receiving the status signals from the plurality of local processing means, and a RF data link electrically coupled to receive output signals from said main processor.

12. The system as defined in claim 11, further comprising battery power means coupled to said main processor.

13. An electromagnetic intrusion sensor system for sensing the presence of an object in accordance with a frequency of a sensor output signal, said system comprising:

a plurality of sensor means each comprising:

a sensing element (24);

a first phase shifter circuit (34) for phase shifting an input signal in accordance with a capacitance of said sensing element so as to output a sense signal;

a second phase shifter circuit (32) for outputting a reference signal having a fixed delay relative to said input signal;

a phase detector circuit (36), coupled to receive said sense and reference signals, for providing a detector output signal having a duty cycle representing the phase differential between said sense and reference signals;

oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal; and a plurality of local processing means each operable for monitoring the frequency of at least one sensor output signal of the plurality of sensor means, and for outputting a status signal in accordance with the monitored at least one sensor output signal, the status signal representing whether an object is present, wherein each of said local processing means provides a single said input signal to n number of said plurality of sensor means, wherein n is greater than 1, wherein each of said local processing means has n number of input terminals for receiving the sensor output signals from said n number of sensor means, respectively, and wherein each of said n number of sensing means are disposed in close proximity to each other.

14. The system as defined in claim 13, wherein $n=3$.

15. The system as defined in claim 14, wherein each of said local processing means outputs a status signal representing the presence of an object only if at least two of said three sensor means output sensor output signals having respective frequencies indicating the presence of an object.

16. An electromagnetic intrusion sensor for sensing the presence of an object in accordance with a frequency of a sensor output signal, said sensor comprising:

a sensing element (24);

first oscillation means for generating an oscillation signal;

a first phase shifter circuit (34) for phase shifting the generated oscillation signal in accordance with a capacitance of said sensing element so as to output a sense signal;

a second phase shifter circuit (14) for outputting a reference signal having a fixed delay relative to the generated oscillation signal;

a phase detector circuit (36), coupled to receive said sense and reference signals, for providing a detector output signal having a duty cycle representing the phase differential between said sense and reference signals; and second oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal.

17. The sensor as defined in claim 16, further comprising a clamp circuit for clamping the detector output signal.

18. The sensor as defined in claim 16, wherein said first oscillation means comprises an exclusive OR gate having an output connected to an input of said first phase shifter.

19. The sensor as defined in claim 16, wherein said predetermined range is between 18 and 24 inches.

20. An electromagnetic instrusion sensor for sensing the presence of an object in accordance with a frequency of a sensor output signal, said sensor comprising:

a sensing element (24);

first oscillation means for generating an oscillation signal;

a first phase shifter circuit (34) for phase shifting the generated oscillation signal in accordance with a capacitance of said sensing element so as to output a sense signal;

a second phase shifter circuit (14) for outputting a reference signal having a fixed delay relative to the generated oscillation signal;

a phase detector circuit (36), coupled to receive said sense and reference signals, for providing a detector output signal having a duty cycle representing the phase differential between said sense and reference signals;

second oscillatory means (38), coupled to receive said detector output signal, for providing the sensor output signal, the sensor output signal having a frequency which changes in accordance with the duty cycle of the detector output signal so that when the object is disposed within a predetermined range of said sensing element the capacitance thereof changes causing the duty cycle of the detector output signal to change, thereby changing the frequency of said sensor output signal; and an integrator, connected to receive the sensor output signal, for converting the sensor output signal to an error signal, said second phase shifter circuit being responsive to the error signal for changing an amount of delay of the reference signal relative to the generated oscillation signal.

* * * * *